United States Patent [19]

Garcia

[11] Patent Number: 4,709,428

[45] Date of Patent: Dec. 1, 1987

[54] SOAP HOLDER COVER

[76] Inventor: Steven A. Garcia, 1729 Procyon, Rio Rancho, N. Mex. 87124

[21] Appl. No.: 924,204

[22] Filed: Oct. 27, 1986

Related U.S. Application Data

[63] Continuation of Ser. No. 767,762, Aug. 21, 1985, Pat. No. 4,654,901.

[51] Int. Cl.[4] ..... A47K 5/00

[52] U.S. Cl. ..... 4/605; 4/628; 312/242; 206/77.1

[58] Field of Search ..... 4/605, 628; 312/242, 312/351; 206/77.1

[56] References Cited

U.S. PATENT DOCUMENTS

| | | | |
|---|---|---|---|
| 2,585,743 | 2/1952 | Cooper | 312/242 X |
| 2,618,884 | 11/1952 | Low | 312/242 |
| 3,054,211 | 9/1962 | Hawk et al. | 206/77.1 |
| 3,054,212 | 9/1962 | Morris | 312/242 X |
| 3,323,850 | 6/1967 | Link | 312/242 |
| 4,300,248 | 11/1981 | Dworkin | 312/242 X |
| 4,344,529 | 8/1982 | Ibarzabal | 206/77.1 |

*Primary Examiner*—Charles E. Phillips

*Attorney, Agent, or Firm*—Rodey, Dickason, Sloan, Akin & Robb

[57] ABSTRACT

A cover for a bathtub/shower soap-holding fixture comprising a shield which wraps around the exterior of the soap-holding fixture and attaches to and rotates about the U-shaped handle of the soap-holding fixture. The invention further comprises a plug which is inserted into the top open space between the U-shaped handle and the wall portion of the fixture. The shield and plug combination prevent water spray from entering the soap dish fixture during a bath or shower, thus preserving soap contained in the soap tray.

1 Claim, 6 Drawing Figures

SOAP HOLDER COVER

This is a continuation of Ser. No. 767,762, filed on Aug. 21, 1985 now U.S. Pat. No. 4,654,901.

BACKGROUND OF THE INVENTION

This invention relates to a wraparound cover and plug for a bathtub/shower-type, soap-holding fixture to prevent water spray from entering the soap-holding fixture during a bath or shower.

Conventional shower and bathtub walls are generally equipped with a ceramic or metal, built-in, soap-holding fixture which contains a lower tray for holding a bar of soap and a U-shaped support located above the soap-holding tray. This U-shaped support is used as a hand-hold or to hang a washcloth on. The U-shaped support extends outwardly from the wall. The soap-holding tray extends outwardly from the wall and is also sometimes recessed into the wall.

The soap-holding fixture is typically located close to the bathtub or at a low position in the shower stall. In such a position, water from an overhead shower sprays or splashes onto soap contained in the fixture, causing the soap to dissolve and to become soft, soggy, and undesireable to use. A puddle generally forms in the tray which further dissolves the soap and causes it to expand and crack.

Several prior art devices have been developed to protect soap contained in such a soap-holding fixture from being exposed to water. U.S. Pat. No. 2,585,743, filed Dec. 27, 1949, entitled SOAP HOLDER COVER, to Cooper, Jr., discloses a soap holder cover, for a conventional soap-holding fixture, having a hinged front and top wall and two side walls which are positioned around the exterior of the soap-holding fixture. The front cover is lifted from the hinge to gain access to the soap. The hinge is located below the U-shaped handle of the soap-holding fixture. The '743 patent device, however, is difficult to manufacture and install, and must be sized in accordance with each variation of soap-holding fixture.

U.S. Pat. No. 3,323,850, filed Aug. 2, 1965, entitled SOAP PROTECTING INSERT FOR SOAP TRAYS, to Link, discloses an insert for a conventional soap-holding fixture which is inserted onto the soap tray and below the U-shaped handle. The insert has a curved top to protect the soap from water spray. The insert, however, does not move or rotate and does not prevent water from splashing upwards into the soap tray.

U.S. Pat. No. 4,300,248, filed Nov. 17, 1981, entitled SNAP-IN SOAP DISH LINER FOR BATHROOM FIXTURES, to Dworkin, discloses an insert for a conventional soap-holding fixture which protects the soap from water spray from above and from the sides. A protrusion on the top face holds the insert in place against the U-shaped support. However, the insert does not have a frontal face to prevent water from spraying or splashing into the soap dish from that direction.

All of the above-mentioned prior art devices have sharp edges which could potentially injure a bather. In addition, the '743 and the '248 patent devices completely obstruct the U-shaped handle so that it cannot be used as an emergency hand-hold if a bather slips.

To overcome the problems of the prior art, it is an object of the present invention to provide a soap holder cover/plug combination which protects soap contained in a conventional bathtub/shower soap-holding fixture from being splashed or sprayed with water.

It is another object of the present invention to provide a soap holder cover which is attractive in appearance, easy to use and install, and can be easily removed for cleaning of the soap-holding fixture and the cover.

Yet another object of the present invention is to provide a soap holder cover which is easy and inexpensive to manufacture.

Still another object of the invention is to provide a soap holder cover which has a safe design.

A further object of the invention is to provide a soap holder cover which adapts to most conventional bathtub/shower soap-holding fixtures.

Other objects and further scope of applicability of the present invention will become apparent from the detailed description to follow, taken in conjunction with the accompanying drawing.

SUMMARY OF THE INVENTION

This invention relates to a soap holder cover for a conventional built-in bathtub/shower soap-holding fixture. The soap holder cover of the invention comprises a curved shield which wraps around the exterior of the soap-holding fixture, attachment means for attaching the shield to the U-shaped support of the soap-holding fixture, and a plug which fits in the top space of the soap-holding fixture.

The shield comprises a curved, channel-shaped member. The shield wraps around and conforms to the lower portion of the soap-holding fixture between and including the U-shaped support and the soap tray. The shield has a similar curvature to that of the U-shaped support. Preferably, the shield extends slightly below the soap tray so that it can be lifted from behind by a finger or fingers to gain access to the soap tray.

The attachment means of the invention attaches the shield to the U-shaped support of the soap-holding fixture. Preferably, the attachment means is integrally formed with the shield from the same material. The attachment means preferably comprises at least one ring-shaped member. The attachment means enables the shield to be lifted or rotated upwards away from the soap tray so that soap can be placed in or taken out of the soap tray. The attachment means also enables the shield to be rotated downwards to be seated in a closed position. In the closed position, water is prevented from entering the soap-holding fixture.

The invention further comprises a plug which fits into and seals off the top portion of the soap-holding fixture. The plug should be contoured so as not to interfere with the attachment means.

Accordingly, a novel soap holder cover has been discovered which is easy and inexpensive to manufacture, simple to install, and which fits most conventional built-in, bathtub/shower soap-holding fixtures. Use of the soap holder cover of the present invention prevents water spray from entering the soap-holding fixture, thereby keeping the soap dry and enabling the soap to last longer.

DESCRIPTION OF THE PREFERRED EMBODIMENT

This invention relates to a novel soap holder cover for a conventional built-in bathtub/shower soap-holding fixture. The invention prevents water from splashing or spraying onto soap contained in the soap-holding fixture.

Figure 1:
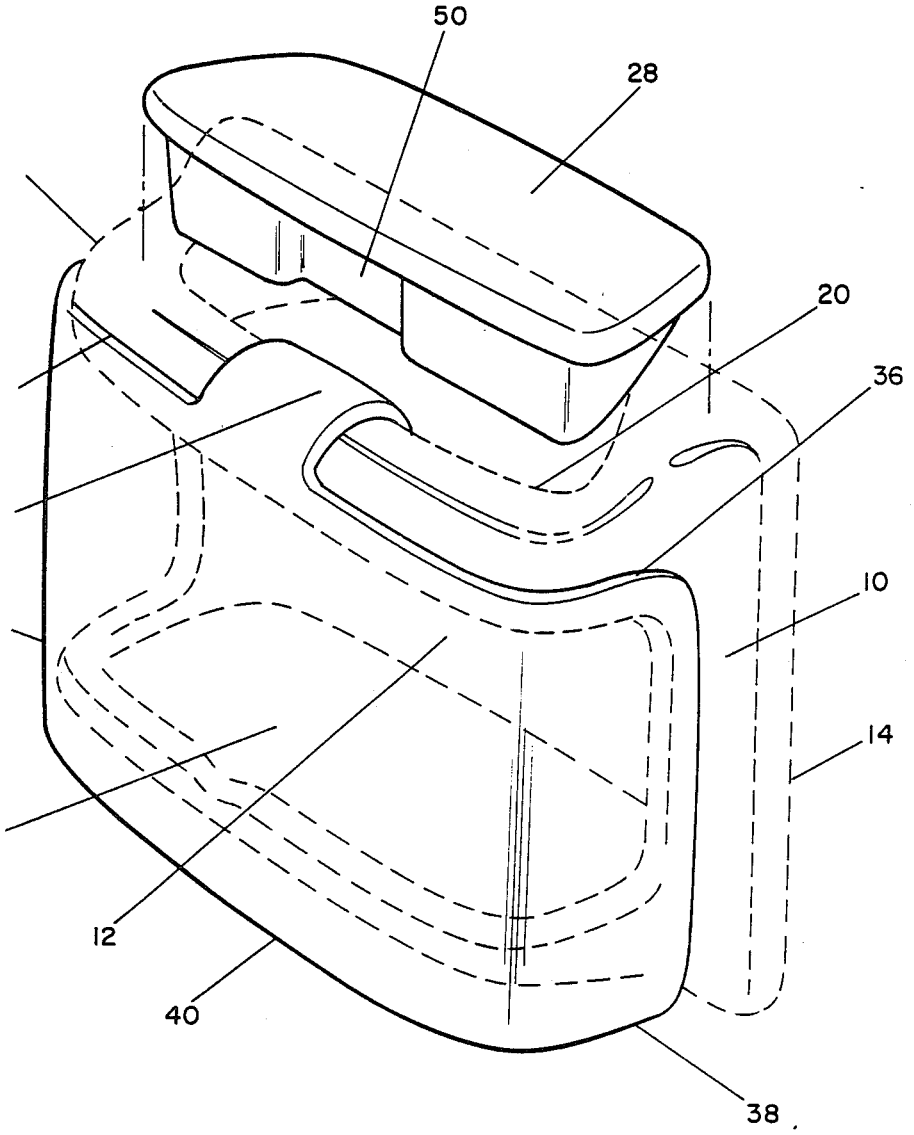
FIG. 1 is a perspective, partially exploded view of a preferred embodiment of the present invention showing the soap holder shield and plug of the invention and their relation to a conventional bathtub/shower-type, soap-holding fixture.

FIG. 1 of the drawing illustrates a conventional bathtub/shower soap-holding fixture 10 and the preferred embodiment of the soap holder cover of the present invention. The soap-holding fixture 10 is built into or attaches to the wall 14 of a shower or bathtub stall. The top of the soap-holding fixture typically has a U-shaped handle or support 16 which is used as a hand-hold. The U-shaped support 16 extends outwardly from the wall 14. The bottom of the soap-holding fixture has a soap tray 18 which holds a bar of soap. The tray 18 extends outwardly from the wall and is also sometimes recessed into the wall. Without a cover, water from a shower or bath can enter the soap-holding fixture 10 through a top space 20 between the U-shaped support 16 and the back of the fixture 12, and through a lower space 22 between the U-shaped support 16 and the soap tray 18.

The soap holder cover of the present invention comprises a shield 24 which wraps around the exterior of the soap-holding fixture 10, attachment means 26 for attaching the shield 24 to the U-shaped support 16 of the fixture, and a plug 28 for sealing the top space 20 between the U-shaped support 16 and the back of the fixture 12. FIG. 1 of the drawing shows the preferred embodiment of the shield and plug of the present invention. The shield 24 comprises a curved, channel-shaped member having a front surface and two side surfaces which covers the exterior of the soap-holding fixture 10 between and including the U-shaped support 16 and the soap tray 18. The wraparound shield 24 prevents water from splashing or spraying into the lower space 22 (see FIGS. 2 and 3) of the fixture and onto soap contained in the soap tray 18 during a shower or bath. The upper edge 48 and lower edge 40 of the shield 24 have generally a similar curvature to that of the U-shaped support 16. The upper edge 48 of the shield is positioned at or slightly below the exterior of the U-shaped support 16. The lower edge 40 of the shield is positioned at or below the bottom of the soap tray 18.

The shield 24 may be made of any number of materials, including plastic, ceramic, wood, glass or metal. The shield may be easily manufactured, especially if made from a plastic material: For example, the shield can be cut out flat and then bent into the curved shape shown in FIG. 1. Hot molding, vacuum forming, blow molding, injection molding, or other techniques common to the art may be utilized for forming the shield when plastic materials are used in the invention. The corners 36 and 38 of the shield 24 may be rounded off to provide an attractive appearance and a safe design. Preferably, the shield has a curvature containing no sharp edges so that it is safe in the event a bather runs into the fixture or slips in the bathtub or shower. The shield 24 could be altered in appearance to have, for example, a highly curved or bubble-shaped front face, and louvres to promote air circulation and thus keep the soap dry.

Figure 2:
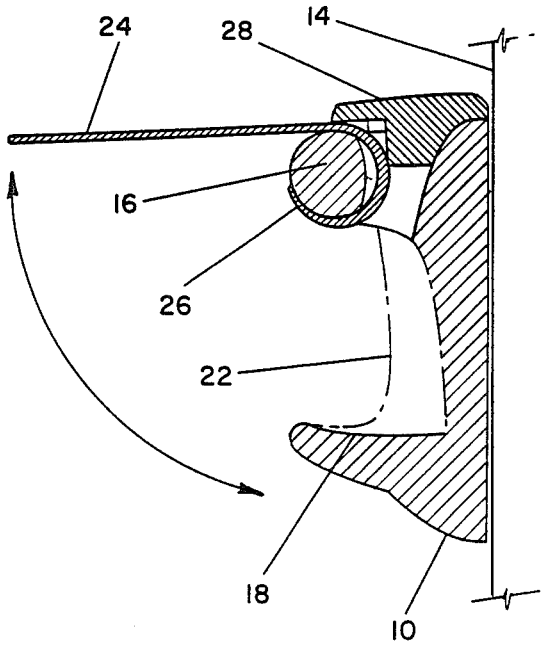
FIG. 2 is a side, cross-sectional view of the preferred embodiment of the present invention showing the shield rotated upwards from the soap tray of the soap-holding fixture for gaining access to a bar of soap.
Figure 3:
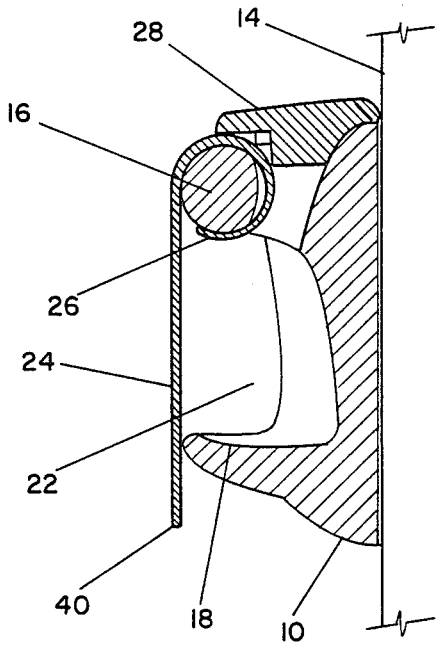
FIG. 3 is a side, cross-sectional view of the preferred embodiment of the present invention showing the shield rotated downward to a closed position for preventing water spray from entering the soap-holding fixture.

Attachment means 26 attach the shield 24 to the U-shaped support 16 of the soap-holding fixture 10. The attachment means 26 enable the shield 24 to be lifted or rotated upwards away from the soap tray to an open position as shown in FIG. 2, or lowered or rotated downwards towards the soap tray to be seated in a closed position as shown in FIG. 3. Preferably, the shield automatically closes. When the shield is in an open position (FIG. 2), soap may be removed from or placed into the soap tray 18. When the shield 24 is in a closed position (FIG. 3), the wraparound design protects the soap from water which sprays or splashes in the area of the soap-holding fixture 10. In the preferred embodiment, the bottom of the shield 40 extends below the soap tray 18 in its closed position (FIG. 3) so that one can easily lift or swing the shield by placing a finger or fingers behind the bottom of the shield 40. Other means for lifting the shield may be utilized, such as a finger-sized notch at the bottom of the shield or a handle on the front of the shield.

Figure 4:
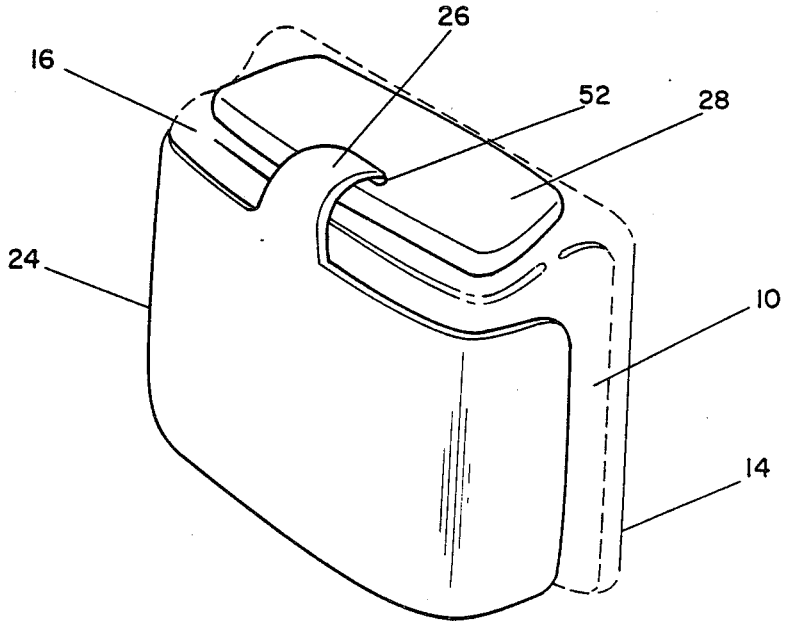
FIG. 4 is a perspective view of an alternative embodiment of the present invention in which the attachment means passes through the plug.
Figure 5:
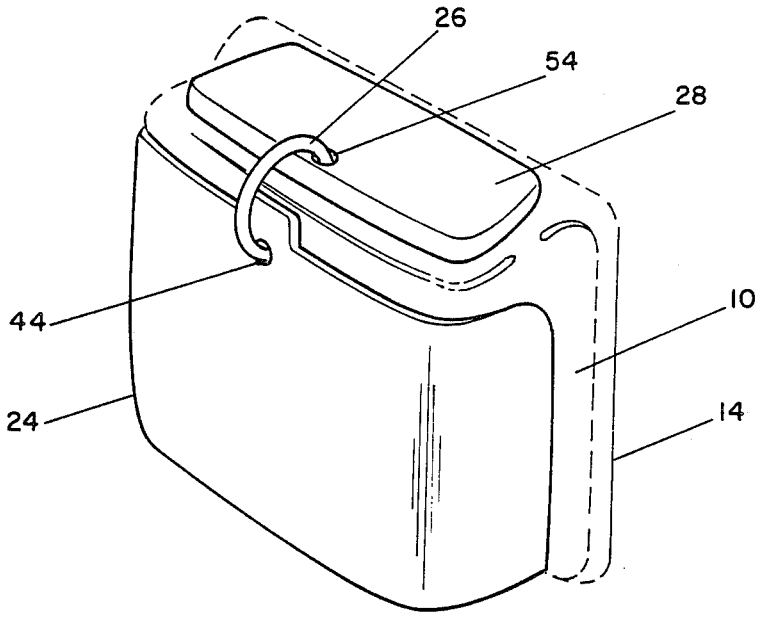
FIG. 5 is a perspective view of an alternative embodiment of an attachment means of the present invention showing a ring which passes through the shield and plug of the invention.
Figure 6:
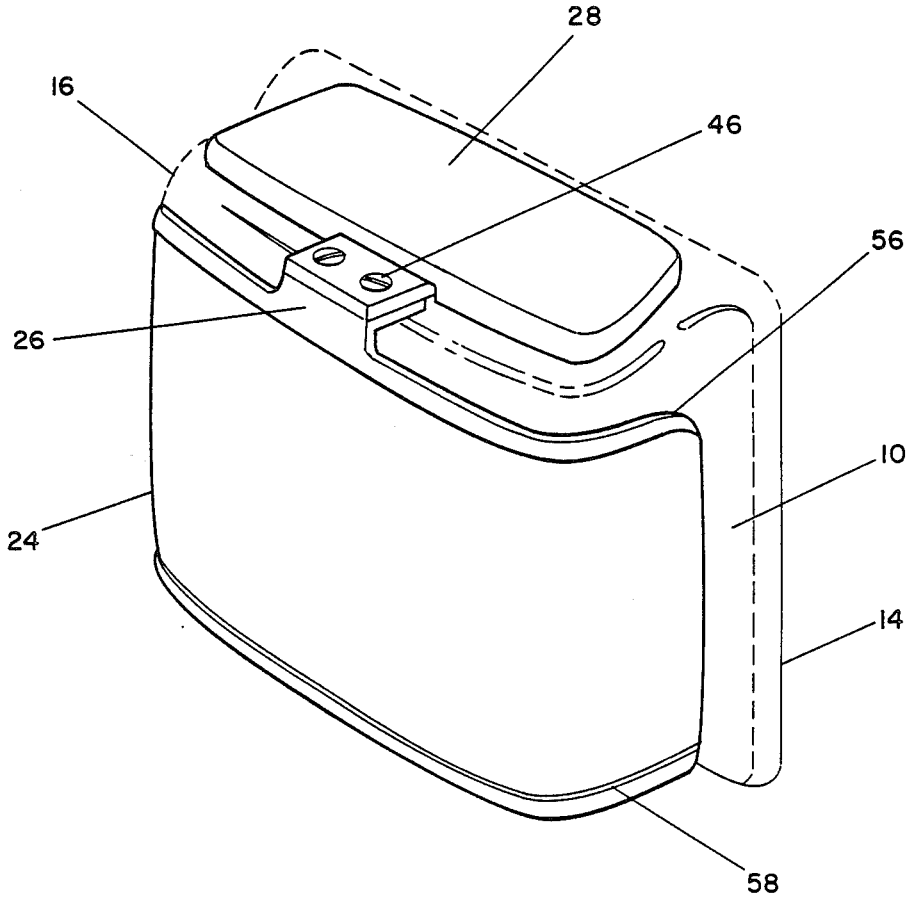
FIG. 6 is a perspective view of an alternative embodiment of the present invention showing a wood or simulated wood shield with decorative trim and attachment means connected to the shield by screws.

In the preferred embodiment (FIG. 1), the attachment means 26 comprises at least one loop or clip which is integrally formed with the shield 24, and is thus made of the same material as the shield 24. Preferably, the attachment means allows for easy removal of the shield and plug for cleaning the soap-holding fixture and for cleaning the soap holder cover of the invention. The attachment means 26 is preferably centrally located in relation to the shield 24 and U-shaped support 16 as shown in FIGS. 1 through 6. The attachment means may be thin or it may be approximately as wide as the U-shaped support. FIG. 4 illustrates an alternative embodiment of the present invention in which the attachment means passes through a slot 52 in the plug 28. When the shield 24 is rotated upwards, the attachment means 26 slides through the slot 52. FIG. 5 illustrates an alternative embodiment of an attachment means 26 comprising a ring which attaches the shield 24 and the plug 28 to the U-shaped support 16 through a hole 44 in the shield and a hole 54 in the plug. In this embodiment, the attachment means 26 may remain stationary, while the shield 24 rotates. The ring may be made of a number of materials, such as plastic, ceramic, wood, glass or metal. FIG. 6 illustrates a further embodiment of an attachment means in which at least one screw or bolt 46 connects the attachment means 26 to the shield 24. FIG. 6 also illustrates a decorative wood or simulated wood shield 24 with attractive top and bottom edged trim 56 and 58.

The present invention further comprises a plug 28 (see FIGS. 1–6) which fits into the top space 20 of the soap-holding fixture to prevent water from entering this top space. The plug 28 is contoured 50 (FIG. 1) so that it is easily placed into position into the top space 20 of the fixture 10 and will not interfere with the attachment means 26 and upwards and downwards rotation of the shield 24. The plug 28 may be separate from the shield 24 and attachment means 26 as illustrated in FIGS. 1, 2, 3 and 6, or the plug may be connected to the attachment means as illustrated in FIGS. 4 and 5. The plug may be made from a number of materials, including water-resistant foam, rubber or ceramic. Preferably, the plug is made of an elastic foam material so that the use of the U-shaped support 16 as a hand-hold is not impaired in the event a bather slips.

Accordingly, a novel soap holder cover has been discovered for covering a conventional bathtub/-shower soap-holding fixture. The cover of the invention prevents water spray from entering the soap-holding fixture and dissolving the soap. The cover is easy and inexpensive to manufacture, simple to install, safe of use and adapts to almost any built-in, bathtub/shower soap-holding fixture.

Although the invention has been described with reference to its preferred embodiments, other embodiments can achieve the same results. Variations and modifications of the present invention will be obvious to those skilled in the art and it is intended to cover in the appended claims all such modifications and equivalents.

I claim:

1. A soap holder cover for a conventional built-in, bathtub/shower soap-holding fixture for preventing water from spraying or splashing on soap contained in said fixture, said fixture generally containing a bottom tray for holding soap, and a U-shaped support having two arms which extend outwardly from and are perpendicular to the bathtub/shower wall and which connect to a front-facing portion which is parallel to the bathtub/shower wall, said soap holder cover comprising:

(a) A shield comprising a curved, channel-shaped member, said curved shield having a front face which when positioned on a conventional bathtub/shower soap holding fixture, when provided, is generally parallel to the bathtub/shower wall, and further comprising two side faces which are generally perpendicular to the front face of said shield, said shield wrapping around the exterior of said soap-holding fixture with the upper edge of said shield being positioned generally at the U-shaped support of the soap-holding fixture and the lower edge of said shield being positioned generally at the soap tray level of said soap-holding fixture when said shield is seated in a closed position, and whereby the upper edge of the front face of the shield pivots about the front-facing portion of said U-shaped support which is parallel to the bathtub/-shower wall; and (b) Attachment means for attaching the upper edge of the front face of said shield to the front-facing portion of said U-shaped support, said attachment means enabling said shield to be rotated upwards and away from said soap tray to an open position to gain access to soap contained in said soap-holding tray, and further enabling said shield to be rotated downwards towards said soap tray to be seated in a closed position to prevent water from spraying or splashing into said soap-holding fixture;. said attachment means is a strip which is made of the same material and integrally formed with said shield as a single unit and said strip being formed into a curved shape so as to wrap around the U-shape support and retain the cover thereto in said upwardly and downwardly rotated positions; whereby when said cover is positioned on the soap-holding fixture, the U-shaped support is exposed and may be utilized as a hand-hold for a bather.

* * * * *

UNITED STATES PATENT AND TRADEMARK OFFICE

CERTIFICATE OF CORRECTION

PATENT NO. : 4,709,428

DATED : December 1, 1987

INVENTOR(S) : Steven A. Garcia

It is certified that error appears in the above-identified patent and that said Letters Patent is hereby corrected as shown below:

The title page showing the illustrative figure and FIG. 1, should be deleted to appear as per attached sheets.

Signed and Sealed this

Tenth Day of May, 1988

*Attest:*

*Attesting Officer*

DONALD J. QUIGG

*Commissioner of Patents and Trademarks*

United States Patent [19]

Garcia

[11] Patent Number: 4,709,428

[45] Date of Patent: Dec. 1, 1987

[54] SOAP HOLDER COVER

[76] Inventor: Steven A. Garcia, 1729 Procyon, Rio Rancho, N. Mex. 87124

[21] Appl. No.: 924,204

[22] Filed: Oct. 27, 1986

Related U.S. Application Data

[63] Continuation of Ser. No. 767,762, Aug. 21, 1985, Pat. No. 4,654,901.

[51] Int. Cl.[4] ..... A47K 5/00

[52] U.S. Cl. ..... 4/605; 4/628; 312/242; 206/77.1

[58] Field of Search ..... 4/605, 628; 312/242, 312/351; 206/77.1

[56] References Cited

U.S. PATENT DOCUMENTS

| | | | |
|---|---|---|---|
| 2,585,743 | 2/1952 | Cooper | 312/242 X |
| 2,618,884 | 11/1952 | Low | 312/242 |
| 3,054,211 | 9/1962 | Hawk et al. | 206/77.1 |
| 3,054,212 | 9/1962 | Morris | 312/242 X |
| 3,323,850 | 6/1967 | Link | 312/242 |
| 4,300,248 | 11/1981 | Dworkin | 312/242 X |
| 4,344,529 | 8/1982 | Ibarzabal | 206/77.1 |

*Primary Examiner*—Charles E. Phillips

*Attorney, Agent, or Firm*—Rodey, Dickason, Sloan, Akin & Robb

[57] ABSTRACT

A cover for a bathtub/shower soap-holding fixture comprising a shield which wraps around the exterior of the soap-holding fixture and attaches to and rotates about the U-shaped handle of the soap-holding fixture. The invention further comprises a plug which is inserted into the top open space between the U-shaped handle and the wall portion of the fixture. The shield and plug combination prevent water spray from entering the soap dish fixture during a bath or shower, thus preserving soap contained in the soap tray.

1 Claim, 6 Drawing Figures

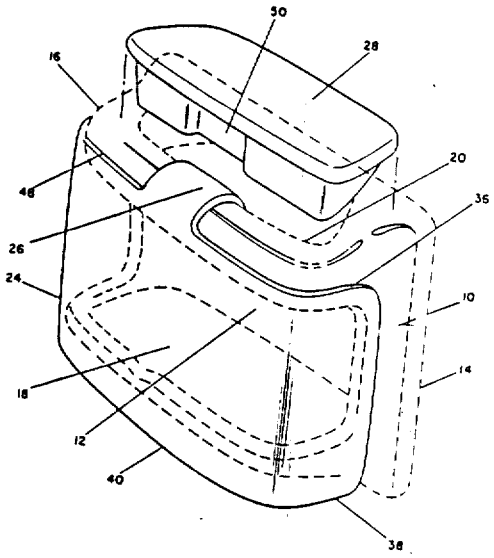

UNITED STATES PATENT AND TRADEMARK OFFICE

CERTIFICATE OF CORRECTION

PATENT NO. : 4,709,428

DATED : December 1, 1987

INVENTOR(S) : Steven A. Garcia

It is certified that error appears in the above-identified patent and that said Letters Patent is hereby corrected as shown below:

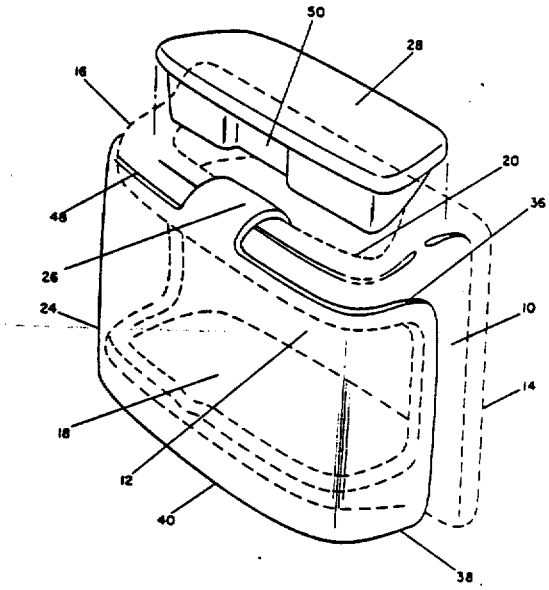

FIG.-1